US008789814B2

(12) United States Patent
Hoffend, Jr.

(10) Patent No.: US 8,789,814 B2
(45) **Date of Patent: *Jul. 29, 2014**

(54) MODULAR LIFT ASSEMBLY

(75) Inventor: Donald A. Hoffend, Jr., Pittsford, NY (US)

(73) Assignee: Daktronics Hoist, Inc., Brookings, SD (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/616,357

(22) Filed: Sep. 14, 2012

(65) Prior Publication Data

US 2013/0001488 A1 Jan. 3, 2013

Related U.S. Application Data

(60) Continuation of application No. 13/280,804, filed on Oct. 25, 2011, now Pat. No. 8,286,946, which is a continuation of application No. 12/878,407, filed on Sep. 9, 2010, now Pat. No. 8,047,507, which is a continuation of application No. 12/189,002, filed on Aug. 8, 2008, now Pat. No. 7,854,423, which is a continuation of application No. 11/185,997, filed on Jul. 20, 2005, now abandoned, which is a division of application No. 10/717,886, filed on Nov. 20, 2003, now abandoned, which is a continuation-in-part of application No. 10/274,725, filed on Oct. 19, 2002, now Pat. No. 6,988,716, which is a continuation-in-part of application No. 10/273,285, filed on Oct. 17, 2002, now Pat. No. 6,691,986, which is a division of application No. 09/627,537, filed on Jul. 28, 2000, now Pat. No. 6,634,622.

(51) Int. Cl.
*B66D 3/08* (2006.01)

(52) U.S. Cl.
USPC ..... 254/388; 254/331

(58) Field of Classification Search
USPC ..... 254/278, 286, 338, 331, 329, 387, 388, 254/389; 160/331, 344, 143
See application file for complete search history.

(56) References Cited

U.S. PATENT DOCUMENTS 977,499 A 12/1910 Bailey
977,500 A * 12/1910 Bailey ..... 472/78

(Continued)

FOREIGN PATENT DOCUMENTS

DE 255522 A1 4/1988
DE 3737612 A1 6/1989

(Continued)

OTHER PUBLICATIONS

U.S. Appl. No. 12/189,002, Notice of Allowance mailed Aug. 9, 2010, 4 pgs.

(Continued)

*Primary Examiner* — Emmanuel M Marcelo
(74) *Attorney, Agent, or Firm* — Schwegman, Lundberg & Woessner, P.A.

(57) ABSTRACT

A modular lift assembly includes a frame, at least one head block connected to the frame, a drum rotatably connected to the frame about an axis of rotation and having at least one winding section, and a drive mechanism operatively connected to the drum for rotating the drum. In various examples, the lift assembly includes at least one loft block internal or external relative to the frame. The loft block is configured to guide a cable from the at least one head block to a load. The lift assembly can further include a load brake positioned along the axis of drum rotation to reduce risks associated with a drive or motor failure.

19 Claims, 8 Drawing Sheets

(56) References Cited

U.S. PATENT DOCUMENTS

| | | | | | |
|---|---|---|---|---|---|
| 1,263,628 | A | | 4/1918 | Vallen | |
| 1,340,066 | A | * | 5/1920 | Lemle | 160/331 |
| 1,473,336 | A | | 11/1923 | Connelly | |
| 1,821,563 | A | | 9/1931 | Mitchell et al. | |
| 2,357,462 | A | | 9/1944 | Ferguson | |
| 2,382,054 | A | * | 8/1945 | Hercik | 254/324 |
| 2,649,279 | A | * | 8/1953 | Jones et al. | 254/329 |
| 2,775,324 | A | | 12/1956 | Tate | |
| 2,811,262 | A | | 10/1957 | Schaitberger | |
| 2,912,180 | A | | 11/1959 | Lindberg | |
| 3,136,358 | A | | 6/1964 | Madsen | |
| 3,313,070 | A | | 4/1967 | Elofson | |
| 3,526,388 | A | | 9/1970 | Geiger et al. | |
| 3,572,703 | A | | 3/1971 | Greene | |
| 4,046,235 | A | | 9/1977 | Shutt | |
| 4,062,519 | A | | 12/1977 | Jacobs | |
| 4,156,521 | A | | 5/1979 | Harman | |
| 4,165,543 | A | * | 8/1979 | Reinert | 4/500 |
| 4,170,308 | A | | 10/1979 | Rogers | |
| 4,251,059 | A | | 2/1981 | Fougea | |
| 4,303,237 | A | | 12/1981 | Hoffend, Jr. et al. | |
| 4,324,386 | A | * | 4/1982 | Gagnon et al. | 254/288 |
| 4,438,903 | A | | 3/1984 | Gagnon et al. | |
| 4,446,587 | A | | 5/1984 | Jump | |
| 4,532,739 | A | | 8/1985 | Cooper | |
| 4,606,527 | A | | 8/1986 | Ziller et al. | |
| 4,624,386 | A | | 11/1986 | Grigorenko et al. | |
| 4,662,628 | A | | 5/1987 | Chatenay epouse Compagnone | |
| 4,772,923 | A | | 9/1988 | Lein | |
| 4,802,787 | A | | 2/1989 | Bays | |
| 4,905,849 | A | | 3/1990 | Coull | |
| 5,003,732 | A | | 4/1991 | Quinnell | |
| 5,031,574 | A | * | 7/1991 | McDowell | 119/448 |
| 5,074,528 | A | | 12/1991 | Long, Jr. | |
| 5,106,057 | A | | 4/1992 | Feller et al. | |
| 5,141,085 | A | | 8/1992 | McCormick | |
| 5,190,250 | A | | 3/1993 | DeLong et al. | |
| 5,263,660 | A | | 11/1993 | Brozik | |
| 5,351,937 | A | | 10/1994 | Nishi et al. | |
| 5,361,565 | A | * | 11/1994 | Bayer | 254/292 |
| 5,492,306 | A | | 2/1996 | Zaguroli, Jr. | |
| 5,553,832 | A | | 9/1996 | Zaguroli, Jr. | |
| 5,555,695 | A | | 9/1996 | Patsy, Jr. | |
| 5,570,872 | A | | 11/1996 | Inoue et al. | |
| 5,586,751 | A | | 12/1996 | Ueno et al. | |
| 5,593,138 | A | | 1/1997 | Zaguroli, Jr. | |
| 5,661,945 | A | | 9/1997 | Henriksson et al. | |
| 5,662,311 | A | | 9/1997 | Waedekin et al. | |
| 5,678,805 | A | | 10/1997 | Moser et al. | |
| 5,711,713 | A | | 1/1998 | Kreuger | |
| 5,772,360 | A | | 6/1998 | Wood, II | |
| 5,794,400 | A | | 8/1998 | Fisher et al. | |
| 5,848,781 | A | | 12/1998 | Kulhavy et al. | |
| 5,865,426 | A | | 2/1999 | Kazerooni | |
| 6,007,054 | A | | 12/1999 | Kobayasi et al. | |
| 6,023,862 | A | | 2/2000 | Sirjola | |
| 6,080,981 | A | | 6/2000 | Payne | |
| 6,085,826 | A | | 7/2000 | Maesaki | |
| 6,118,652 | A | | 9/2000 | Casby et al. | |
| 6,155,538 | A | | 12/2000 | Winter | |
| 6,299,139 | B1 | | 10/2001 | Kazerooni | |
| 6,364,062 | B1 | | 4/2002 | Ericson et al. | |
| 6,385,493 | B1 | | 5/2002 | Hennessey et al. | |
| 6,517,054 | B2 | | 2/2003 | Samejima | |
| 6,520,485 | B1 | * | 2/2003 | Soot | 254/331 |
| 6,554,252 | B2 | | 4/2003 | Kazerooni et al. | |
| 6,615,564 | B2 | | 9/2003 | Lutrario et al. | |
| 6,634,621 | B2 | | 10/2003 | Keith | |
| 6,634,622 | B1 | | 10/2003 | Hoffend, Jr. | |
| 6,691,986 | B2 | | 2/2004 | Hoffend, Jr. | |
| 6,729,605 | B2 | | 5/2004 | Brackman et al. | |
| 6,802,170 | B2 | | 10/2004 | Davis | |
| 6,807,790 | B2 | | 10/2004 | Strickland et al. | |
| 6,889,958 | B2 | | 5/2005 | Hoffend, Jr. | |
| 6,988,716 | B2 | | 1/2006 | Hoffend, Jr. | |
| 6,997,442 | B2 | | 2/2006 | Hoffend, Jr. | |
| 7,014,172 | B2 | * | 3/2006 | Kataoka | 254/338 |
| 7,210,670 | B2 | | 5/2007 | Franks | |
| 7,234,685 | B2 | | 6/2007 | Britten | |
| 7,264,227 | B2 | | 9/2007 | Miller et al. | |
| 7,284,744 | B1 | | 10/2007 | Lerchenmueller et al. | |
| 7,360,576 | B2 | | 4/2008 | Lin | |
| 7,364,136 | B2 | | 4/2008 | Hossler | |
| 7,484,712 | B2 | * | 2/2009 | Hossler | 254/331 |
| 7,562,863 | B2 | * | 7/2009 | Kochan et al. | 254/394 |
| 7,854,423 | B2 | | 12/2010 | Hoffend, Jr. | |
| 8,047,507 | B2 | | 11/2011 | Hoffend, Jr. | |
| 8,286,946 | B2 | | 10/2012 | Hoffend, Jr. | |
| 2003/0030045 | A1 | | 2/2003 | Hoffend, Jr. | |
| 2003/0111652 | A1 | | 6/2003 | Hoffend, Jr. | |
| 2004/0084665 | A1 | | 5/2004 | Hoffend, Jr. | |
| 2004/0098944 | A1 | | 5/2004 | Hoffend, Jr. | |
| 2004/0099852 | A1 | | 5/2004 | Hoffend, Jr. | |
| 2004/0183060 | A1 | | 9/2004 | Hoffend, Jr. | |
| 2005/0247919 | A1 | | 11/2005 | Hoffend, Jr. | |
| 2006/0169662 | A1 | | 8/2006 | Hoffend, Jr. | |
| 2006/0284151 | A1 | * | 12/2006 | Hossler | 254/278 |
| 2007/0181862 | A1 | | 8/2007 | Hossler | |
| 2009/0045381 | A1 | | 2/2009 | Hoffend | |
| 2009/0140221 | A1 | | 6/2009 | Kochan et al. | |
| 2011/0001101 | A1 | | 1/2011 | Hoffend, Jr. | |
| 2012/0037863 | A1 | | 2/2012 | Hoffend, Jr. | |

FOREIGN PATENT DOCUMENTS

| | | | |
|---|---|---|---|
| DE | 4204153 | A1 | 8/1993 |
| DE | 29912572 | U1 | 9/1999 |
| EP | 0540136 | A1 | 5/1993 |
| EP | 0639684 | A1 | 2/1995 |
| EP | 0778239 | A1 | 6/1997 |
| FR | 2689415 | A1 | 10/1993 |

OTHER PUBLICATIONS

U.S. Appl. No. 12/189,002, Non-Final Office Action mailed Feb. 22, 2010, 7 pgs.

U.S. Appl. No. 12/189,002, Non-Final Office Action mailed Jul. 13, 2009, 5 pgs.

U.S. Appl. No. 12/189,002, Response filed May 19, 2010 to Non Final Office Action mailed Feb. 22, 2010, 8 pgs.

U.S. Appl. No. 12/189,002, Response filed Oct. 13, 2009 to Non Final Office Action mailed Jul. 13, 2009, 9 pgs.

U.S. Appl. No. 12/878,407, Non Final Office Action mailed Apr. 1, 2011, 5 pgs.

U.S. Appl. No. 12/878,407, Non Final Office Action mailed Dec. 22, 2010, 7 pgs.

U.S. Appl. No. 12/878,407, Notice of Allowance mailed Jul. 26, 2011, 5 pgs.

U.S. Appl. No. 12/878,407, Response filed Jan. 13, 2011 to Non Final Office Action mailed Dec. 22, 2010, 7 pgs.

U.S. Appl. No. 12/878,407, Response filed Jun. 30, 2011 to Non Final Office Action mailed Apr. 1, 2011, 9 pgs.

U.S. Appl. No. 13/280,804, Response filed May 17, 2012 to Non Final Office Action mailed Mar. 20, 2012, 7 pgs.

U.S. Appl. No. 13/280,804, Non Final Office Action mailed Mar. 20, 2012, 8 pgs.

U.S. Appl. No. 13/280,804, Notice of Allowance mailed Jun. 11, 2012, 5 pgs.

"Cyclorama Batten Systems", Regional Performing Arts Center, Philadelphia, PA, (Dec. 15, 1999), 3 pgs.

* cited by examiner

MODULAR LIFT ASSEMBLY

CROSS-REFERENCE TO RELATED APPLICATIONS

This application is a continuation of U.S. patent application Ser. No. 13/280,804 filed Oct. 25, 2011, now allowed, which is a continuation of U.S. patent application Ser. No. 12/878,407 filed Sep. 9, 2010, now U.S. Pat. No. 8,047,507, which is a continuation of U.S. patent application Ser. No. 12/189,002 filed Aug. 8, 2008, now U.S. Pat. No. 7,854,423, which is a continuation of U.S. patent application Ser. No. 11/185,997 filed Jul. 20, 2005, now abandoned, which is a divisional of U.S. patent application Ser. No. 10/717,886 filed Nov. 20, 2003, now abandoned, which is a continuation-in-part of U.S. patent application Ser. No. 10/274,725 filed Oct. 19, 2002, now U.S. Pat. No. 6,988,716, which is a continuation-in-part of U.S. patent application Ser. No. 10/273,285 filed Oct. 17, 2002, now U.S. Pat. No. 6,691,986, which is a divisional of U.S. patent application Ser. No. 09/627,537 filed Jul. 28, 2000, now U.S. Pat. No. 6,634,622, the specification of each of which is herein incorporated by reference in its entirety.

This application is also related to U.S. application Ser. No. 10/690,132 filed Oct. 21, 2003, now U.S. Pat. No. 6,889,958, U.S. application Ser. No. 10/813,424 filed Mar. 29, 2004, now U.S. Pat. No. 6,997,442, U.S. application Ser. No. 11/463,823 filed Aug. 10, 2006, now U.S. Pat. No. 7,293,762, and U.S. application Ser. No. 11/325,401 filed Jan. 4, 2006, now U.S. Pat. No. 7,258,325, the specifications of which are herein incorporated by reference in their entirety.

TECHNICAL FIELD

This patent document pertains generally to lift and hoist mechanisms. More particularly, but not by way of limitation, this patent document pertains to a lift assembly that can be employed for raising and lowering a load in theatrical and staging environments, wherein the lift assembly is a modular self contained unit that can be readily installed in a wide variety of building configurations.

BACKGROUND

Performance venues such as theaters, arenas, concert halls, auditoriums, schools, clubs, convention centers and television studios employ battens or trusses to suspend lighting, scenery, drapery and other equipment which is moved relative to a stage or floor. These battens usually include pipe or joined pipe sections that form a desired length of the batten. The battens can be 50 feet or more in length. To support heavy loads or where suspension points are spaced 15-30 feet apart, the battens may be fabricated in either ladder, triangular or box truss configurations.

Battens often need to be lowered for exchanging and servicing the suspended equipment. To reduce the power necessary to raise and lower the battens, the battens are often counterweighted. The counterweights reduce the effective weight of the battens and any associated loads.

A typical counterweight system represents a significant cost. The creation of T-bar wall 70 feet to 80 feet in height and 30 feet deep may require over three weeks. Even after installation of the T-bar wall, head block beams, loading bridges, index lights and hoist systems must be integrated. Therefore, a substantial cost is incurred in the mere installation of a counterweight system. The total installation time may range from 6 to 12 weeks.

A number of elevating or hoisting systems are available for supporting, raising and lowering battens. One of the most common and least expensive batten elevating systems is a counterweighted carriage which includes a moveable counterweight for counterbalancing the batten and equipment supported on the batten.

Another common elevating or hoisting system employs a winch to raise or lower the battens. Usually hand or electric operated winches are used to raise or lower the battens. Occasionally in expensive operations, a hydraulic or pneumatic motorized winch or cylinder device is used to raise and lower the batten.

Many elevating systems have one or more locking devices and at least one form of overload limiting device. In a counterweight system, a locking device may include a hand operated rope that is attached to one end of the top of the counterweight arbor (carrying device) and then run over a head block, down to the stage, through a hand rope block for locking the counterweight in place, and then around a floor block and back up to the bottom of the counterweight arbor. The hand rope lock locks the rope when either the load connected to the batten or the counterweight loads are being changed and rebalanced and locks the loads when not moving.

In a sandbag counterweight system, the locking device is merely a rope tied off to a stage mounted pin rail, while the overload limit is regulated by the size of the sandbag. In this rigging design, however, a number of additional bags can be added to the set of rope lines, and thereby exceed the safe limit of suspension ropes and defeat the overload-limiting feature.

Hand operated winches will occasionally free run when heavily loaded and will then dangerously drop the suspended load. Other types of hand winches use a ratchet lock, but again these winches are also susceptible to free running when they are heavily loaded and hand operated.

BRIEF SUMMARY

The present inventor has recognized, among other things, that a need exists for a lift assembly that can replace traditional counterweight systems. The need further exists for a lift assembly that can be readily installed into a variety of building configurations and layouts. A need further exists for a lift assembly having a modular construction to facilitate configuration to any of a variety of installations. A need also exists for a lift assembly that can maintain a predetermined fleet angle during raising or lowering of a load.

The present lift assembly can include a frame, at least one head block connected to the frame, and a drum rotatably connected to the frame about a longitudinal axis of the drum. In some examples, the drum can be translatable along its longitudinal axis relative to the at least one head block to maintain a cable predetermined fleet angle between the drum and the at least one head block.

In a further configuration, the present lift assembly can include a bias mechanism such as a torsion spring connected between the frame and the drum for reducing the effective weight of the load or batten and any associated equipment.

The lift assembly employs a modular frame for accommodating a different number of head blocks. The lift assembly can also include a modular drum construction which allows for the ready and economical configuration of the system to accommodate various stage sizes. The lift assembly further contemplates that the head blocks connected to the frame can be radially spaced about the axis of drum rotation. In a further configuration, the head blocks can be radially and longitudinally spaced relative to axis of drum rotation, to lie in a helical or a serpentine path relative to the drum for example.

The lift assembly further contemplates a load brake for reducing the risks associated with drive or motor failures. In addition, the present lift assembly contemplates a clip assembly for readily engaging the frame with structural beams, which can have any of a variety of dimensions. In addition, a power/control strip can be provided for supplying the power to a lift assembly as well as control signals.

The present lift assembly can further include one or more loft blocks for guiding the cable from the modular frame to the battens. In a further configuration, the present lift assembly contemplates selective height or trim adjustment for a section of a batten relative to the respective cable. A further configuration of the present lift assembly provides a safety stop for terminating movement of batten upon detection of an obstacle in an intended travel path of the batten.

The present lift assembly provides a turnkey lift assembly having rigging; power and control for the manipulation of battens, without requiring construction of traditional counterweight systems or relying on previously installed counterweight systems.

These and other examples, advantages, and features of the present lift assembly will be set forth in part in following Detailed Description. This Summary is intended to provide an overview of the subject matter of the present patent document. It is not intended to provide an exclusive or exhaustive explanation of the present subject matter. The Detailed Description is included to provide further information about the present patent document.

BRIEF DESCRIPTION OF THE DRAWINGS

In the drawings, like numerals have been used to describe similar components throughout the several views. Like numerals having different letter suffixes have been used to represent different instances of similar components. The drawings illustrate generally, by way of example, but not by way of limitation, various embodiments described in the present document.

DETAILED DESCRIPTION

Figure 1:
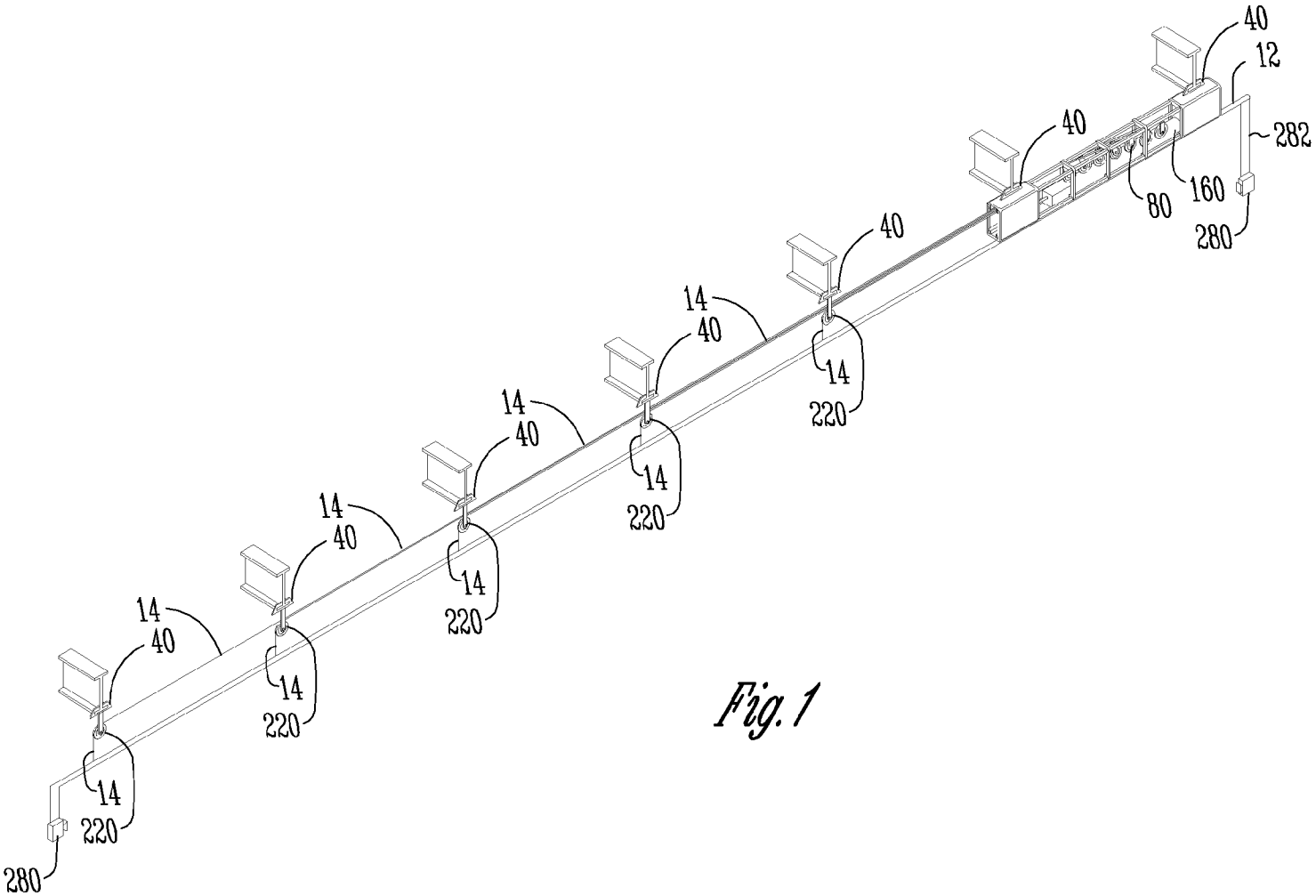
FIG. 1 is a perspective partial cutaway view of a building having a plurality of structural members to which the lift assembly is connected.

Referring to FIG. 1, the present lift assembly 10 is employed to selectively raise, lower and locate a batten 12 relative to a building or surrounding structure. Preferably, the lift assembly 10 moves a connected batten 12 between a lowered position and a raised position.

Although the term "batten" is used in connection with theatrical and staging environment, including scenery, staging, lighting as well as sound equipment, it is understood the term encompasses any load connectable to a windable cable.

The term "cable" is used herein to encompass any wire, metal, cable, rope, wire rope or any other generally inelastic windable material.

The term "building" is used to encompass a structure or facility to which the lift assembly is connected, such as but not limited to, performance venues, theaters, arenas, concert halls, auditoriums, schools, clubs, educational institutions, stages, convention centers, television studios showrooms and places of religious gathering. Building is also understood to encompass cruise ships which may employ battens.

Figure 2:
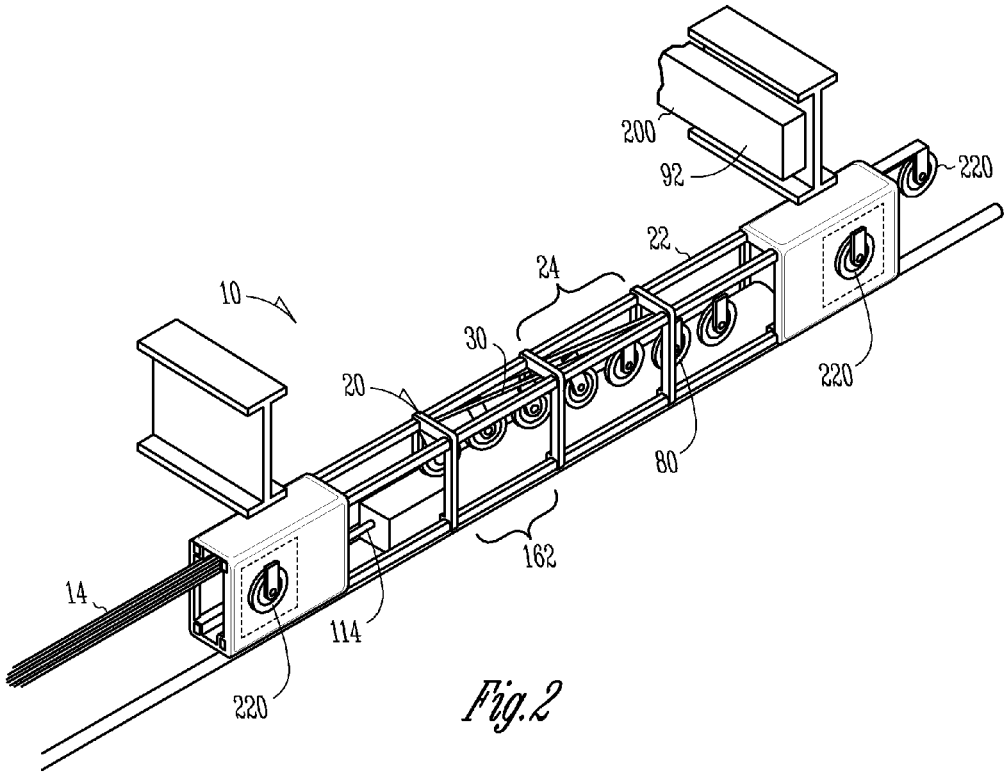
FIG. 2 is an enlarged perspective partial cutaway view of the installed lift assembly.
Figure 3:
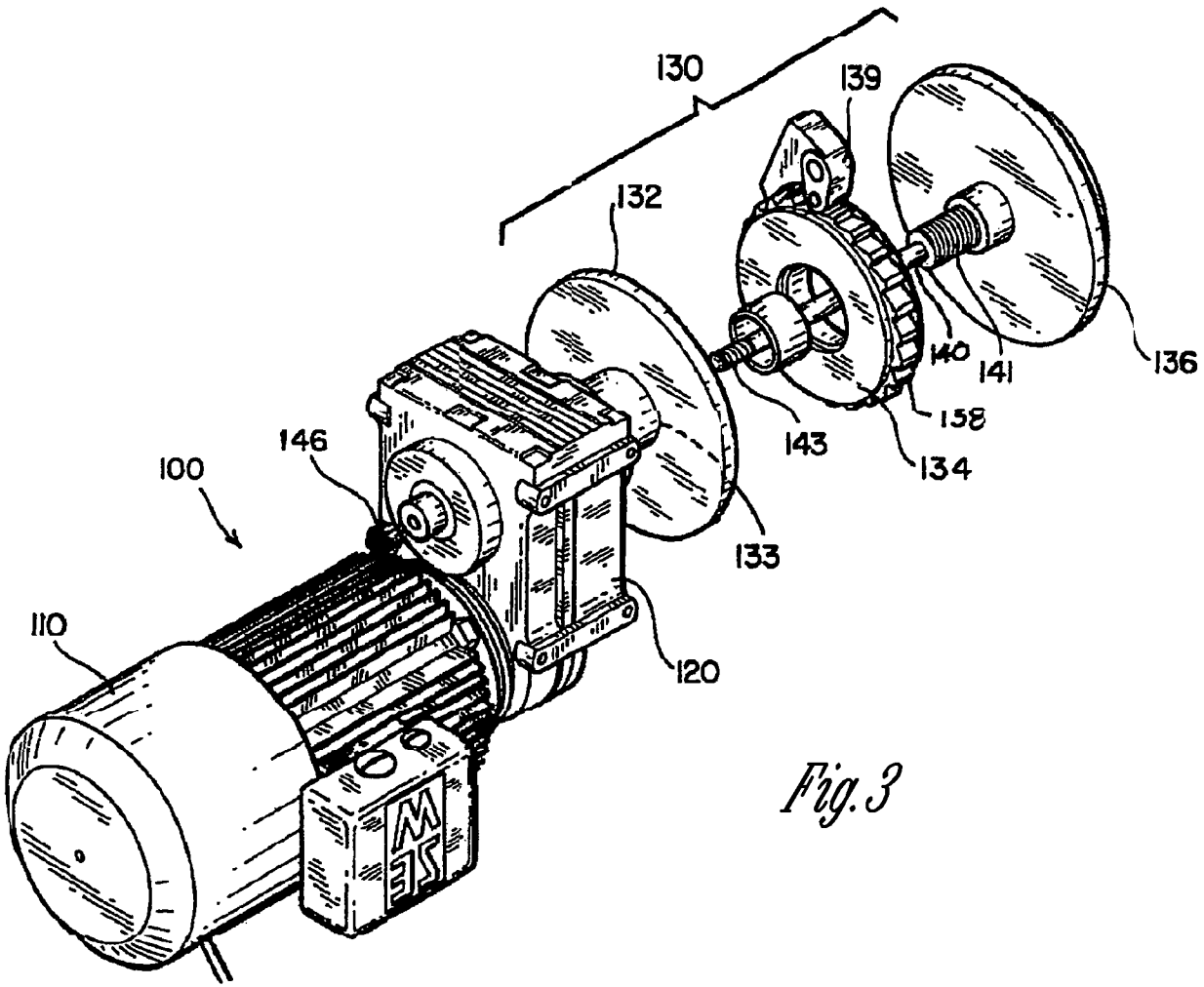
FIG. 3 is an exploded perspective view of a drive mechanism for the lift assembly.

Referring to FIGS. 1, 2 and 3, the lift assembly 10 can include a frame, at least one head block 80, a drive mechanism 100, a rotatable drum 160 and a corresponding loft block 220.

The lift assembly 10 can be constructed to cooperate with at least one cable 14. Typically, the number of cables is at least four, but may be as many as eight or more. As shown in the figures, a cable path can extend from the drum 160 through a corresponding head block 80 to pass about a loft block 220 and terminate at the batten 12.

Frame:

As shown in FIGS. 1 and 2, the frame 20 can include a rigid skeleton to which the drum 160, the drive mechanism 100 and the head block 80 are attached. According to at least one configuration, the frame 20 can be sized to enclose the drive mechanism 100, the drum 160, a head block 80 and a loft block 220. However, it is understood the frame can include a backbone to which the components are connected.

The frame 20 may be in the form of a grid or a box. The frame 20 can be formed of angle irons, rods, bars, tubing or other structural members. Typically, the frame 20 includes interconnected runners, struts and crossbars 22. The runners, struts and crossbars may be connected by welding, brazing, rivets, bolts or releasable fasteners. The particular configuration of the frame is at least partially dictated by the intended operating environment and anticipated loading. To reduce the weight of the frame 20, a relatively lightweight and strong material such as aluminum is used in various embodiments. However, other materials including, but not limited to, metals, alloys, composites and plastics can be used in response to design parameters. Although the frame 20 is shown in skeleton configuration, it is understood the frame may be enclosed as a box or enclosure having walls to define and enclose an interior space.

In some embodiments, the frame 20 is formed from a plurality of modular sections 24, wherein the sections may be readily interconnected to provide a frame of a desired length. Thus, the frame 20 may accommodate a variety of cables and hence drum lengths.

The frame 20 is constructed to be connectable to the building. The frame 20 can include a fixed coupler and a sliding coupler, wherein the distance between the fixed coupler and the sliding coupler can be varied to accommodate a variety of building spans. Typically connections of the frame 20 to the building include clamps, fasteners, bolts and ties. These connectors may be incorporated into the frame, or are separate components attached during installation of the frame. As set forth herein, adjustable clip assemblies 40 are provided for retaining the frame relative to the building.

The frame 20 also includes or cooperatively engages mounts for the drive mechanism and bearings for the drum.

Specifically, the frame can include a pair of rails for supporting the drive mechanism, a translating shaft and a threaded keeper. As set forth in the description of the drive mechanism 100, the drive mechanism can be connected to the frame 20 for translation with the drum along the axis of rotation of the drum.

In the first configuration of the frame 20, the frame has an overall length of approximately 10 feet, a width of approximately 11 inches and a height of approximately 17 inches.

The frame 20 can include a head block mount 30 for locating the head blocks in a fixed position relative to the frame. In some embodiments, the head block mount 30 is a helical mount concentric with the axis of drum rotation. The inclination of the helical mount is at least partially determined by the length of the drum 160, the size of associated head blocks 80, the spacing of the installed frame and the number of cables to be drawn from the drum. Thus, the helical head block mount 30 may extend from approximately 5 degrees of the drum to over 180 degrees. The helical mounting allows the head blocks 80 to overlap along the longitudinal axis of drum rotation, without creating interfering cable paths.

Although the helical mount 30 is shown as a continuous curvilinear strut, it is understood a plurality of separate mounts can be employed, wherein the separate mounts are selected to define a helical or a serpentine path about the axis of rotation of the drum 160.

In a further construction, the head block mounts 30 can be merely radially spaced about the axis of drum rotation at a common longitudinal position along the axis of drum rotation. That is, rather than being disposed along the longitudinal axis of the drum 160, the head block mounts 30 are located at a fixed longitudinal position of the drum. However, it has been found that the width of the frame 20 can be reduced by radially and longitudinally displacing the head blocks 80 along a serpentine path about the axis of drum rotation, wherein the head blocks lie within approximately 100 degrees, such as 90 degrees of each other.

As shown in FIGS. 1 and 2, in the seven-cable configuration, the lift assembly 10 includes two internal and five external loft blocks 220. The internal loft blocks 220 are located within the frame 20 and the external loft blocks 220 are operably mounted outside the frame, as seen in FIG. 1. However, the lift assembly 10 can be configured to locate a plurality of external loft blocks 220 from each end of the frame. That is, two or more loft blocks 220 may be spaced from one end of the frame 20 and two or more loft blocks may be spaced from the remaining end of the frame.

In addition, depending upon the configuration of the lift assembly 10, the number of internal loft blocks 220 can range from none to one, two, three or more.

Hoisting Adapter:

In addition, the frame may include a hoisting adapter 26 or mounts for releasably engaging the hoisting adapter. It is anticipated a plurality of hoisting adapters can be employed, as at least partially dictated by the size of the frame 20 and the configuration of the building. The hoisting adapter 26 can include a sheave 28, such as a loft block connected to spaced apart locations of the frame. The hoisting adapter 26 can also include a clip assembly 40 for releasably engaging a beam of the building. The hoisting adapter 26 can be selected so that the frame may be hoisted to an operable location and connected to the building by additional clip assemblies 40.

Head Blocks:

A plurality of head blocks 80 can be connected to the head block mount 30. The number of head blocks corresponds to the number of cables 14 to be controlled by the lift assembly 10. The head blocks 80 provide a guide surface about which the cable path changes direction from the drum 160 to a generally horizontal direction. The guide surface may be in the form of sliding surface or a moving surface that moves corresponding to travel of the cable. Each head block 80 draws cable 14 from a corresponding winding section along a tangent to the drum 160. The angle between the head block 80 and the respective cable take off point from the drum 160 may be repeated by each of the head blocks 80 relative to the drum.

As the head blocks 80 are mounted to the head block mount 30, such as the helical mount, the head blocks can overlap along the axis of drum rotation. The overlap allows for size reduction in the lift assembly 10. That is, a helical mounting of the head blocks 80 allows the head blocks to overlap radially as well as longitudinally relative to the axis of drum rotation. By overlapping radially, the plurality of head blocks 80 can be operably located within a portion of the drum circumference, and, for example, within a 90 degree arc. Thus, the operable location of the head blocks 80 can be accommodated within a diameter of the drum. By disposing the head blocks within a dimension substantially equal to the diameter of the drum 160, the frame 20 width can be reduced to substantially that of the drum diameter.

In various embodiments, each head block 80 generally includes a pair of side plates, a shaft extending between the side plates, accompanying bearings between the plates and the shaft, and a pulley (sheave) connected to the shaft for rotation relative to the side plates. The head block 80 may also include a footing for connecting the head block to the head block mount and hence the frame. It is understood the head blocks 80 may have any of a variety of configurations such as guide surfaces or wheels that permit translation of the cable relative to the head block, and the present lift assembly is not limited to a particular type of construction of the head block.

Figure 4A:
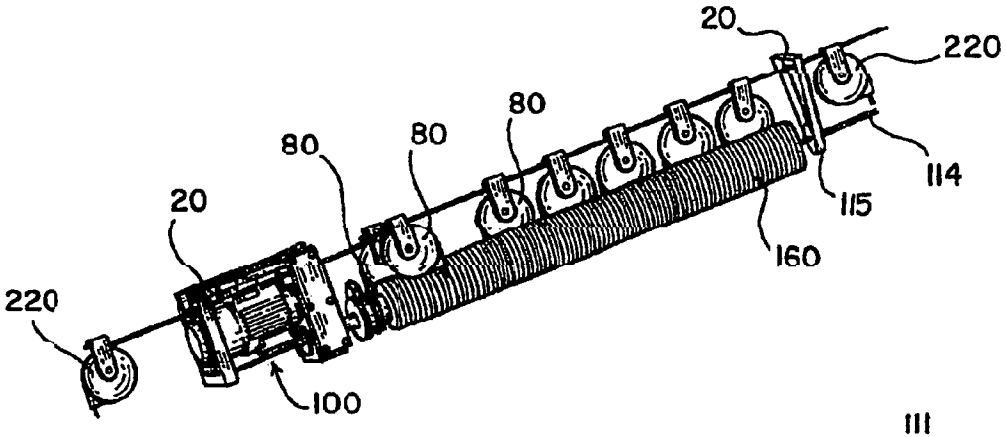
FIG. 4*a* is a perspective view of the connection of the drum, drive mechanism and frame for rotation of the drum and translation of the drum and drive mechanism.
Figure 4B:
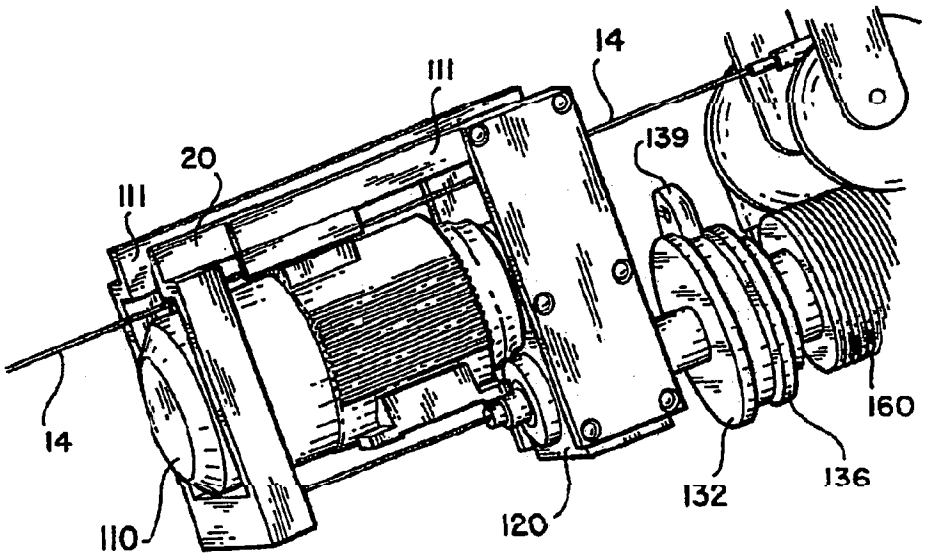
FIG. 4*b* is an enlarged view of a portion of FIG. 4*a*.
Figure 5:
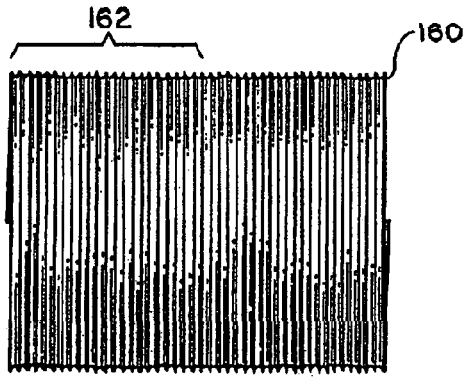
FIG. 5 is a side elevational view of a drum.

Drive Mechanism:

The drive mechanism 100 can be operably connected to the drum 160 for rotating the drum and translating the drum along its longitudinal axis, the axis of drum rotation. Referring to FIGS. 4*a* and 4*b*, the drive mechanism 100 includes a motor 110, such as an electric motor, and a gearbox 120 for transferring rotational motion of the motor to a drive shaft 114. The motor 110 may be any of a variety of high torque electric motors such as ac inverter duty motors, dc or servo motors as well as hydraulic motors.

The gearbox 120 can be selected to rotate the drive shaft 114, and the drum, in a winding (raising) rotation and an unwinding (lowering) rotation. The gearing of the gearbox 120 is at least partially determined by the anticipated loading, the desired lifting rates (speeds) and the motor. A typical gearbox is manufactured by SEW or Emerson.

The drive mechanism 100 may be connected to the frame 20 such that the drive mechanism and the drum 160 translate relative to the frame during rotation of the drum. In some embodiments, the drive mechanism 100 and the frame 20 are sized so that the drive mechanism is enclosed by the frame. Alternatively, the drive mechanism 100 may be connected to a platform that slides outside the frame 20 and thus translates along the axis of rotation with the drum. The choice for connecting the drive mechanism 100 to the frame 20 is at least partially determined the intended operating parameters and manufacturing considerations.

In some constructions, such as those shown in FIGS. 4*a* and 4*b*, the drive shaft 114 includes a threaded drive portion. The drive portion may be formed by interconnecting a threaded rod to the shaft or forming the shaft with a threaded drive portion. The threaded drive portion is threadingly engaged with a keeper 115, which in turn is fixedly connected to the frame 20. The keeper 115 includes a threaded portion or a nut affixed to a plate which receives the threaded portion. That is, referring to FIG. 2, rotation of the shaft 114 not only rotates the drum 160, but the drum translates to the left or the right relative to the frame 20 and hence relative to the attached head blocks. As the drive mechanism 100 is attached to the drum 160 and attached to the frame 20 along a linear slide 111, the drive mechanism also translates along the axis of drum rotation relative to the frame.

The drive shaft can have any of a variety of cross sections. In some embodiments, a construction of the drive shaft has a faceted cross section such as hexagonal.

Drum:

The drum 160 can be connected to the frame 20 for rotation relative to the frame about the axis of rotation and translation relative to the frame along the axis of rotation. Thus, the drum 160 is rotatable relative to the frame 20 in a winding rotation with accompanying winding translation and an unwinding rotation with accompanying unwinding translation for winding or unwinding a length of cable 14 about a respective winding section.

As shown in FIGS. 1 and 2, the drum 160 is horizontally mounted and includes the horizontal longitudinal axis of rotation. The drum 160 includes at least one winding section 162. The winding section 162 is a portion of the drum 160 constructed to receive a winding of the cable 14 for a given drop line. The winding section 162 may include a channeled or contoured surface for receiving the cable. Alternatively, the winding section 162 may be a smooth surface. The number of winding sections 162 corresponds to the number of cables 14 to be controlled by the lift assembly 10. As shown in FIG. 2, there are seven winding sections 162 on the shown drum.

Each winding section 162 can be sized to retain a sufficient length of cable 14 to dispose a connected batten 12 between a fully lowered position and a fully raised position. As shown, a single winding of cable 14 is disposed on each winding section 162. However, it is contemplated that the drum 162 may be controlled to provide multiple layers of winding within a given winding section 162.

As shown in FIGS. 5-8, in one configuration of the lift assembly 10, the drum 160 is a modular construction. The drum 160 is formed of at least one segment 170. The drum segment 170 defines at least a portion of a winding section 162. In a first configuration, each drum segment 170 is formed from a pair of mating halves about the longitudinal axis. Each half includes an outer surface defining a portion of the winding section and an internal coupling surface. The internal coupling surface of the drum corresponds to a portion of the cross section of the drive shaft 114.

When assembled, the drum halves form an outer winding section and the internal coupling surface engages the faceted drive shaft for rotating the drum. Although the internal coupling surface of the drum can have a variety of configurations including slots, detents or teeth, at least one construction employs a faceted drive 114 shaft such a triangular, square, hexagonal, octagonal cross-section.

Figure 6:
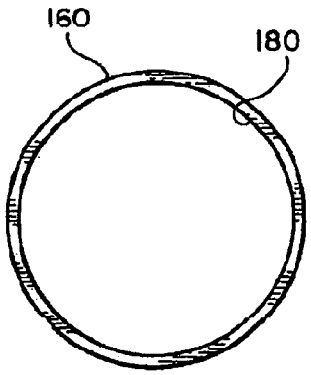
FIG. 6 is an end elevational view of a drum.
Figure 8:
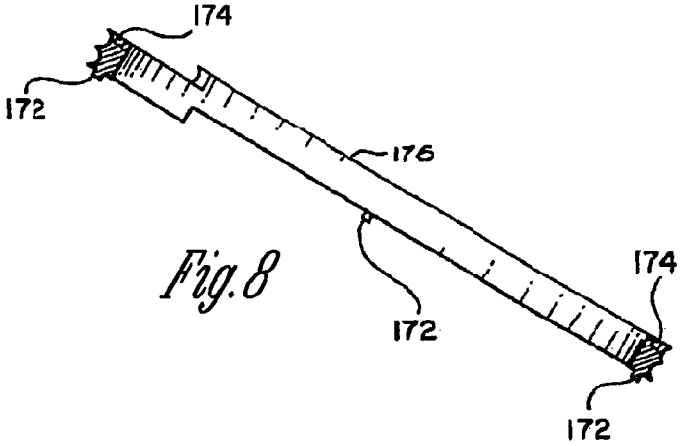
FIG. 8 is a cross-sectional view of a longitudinal drum segment.

Referring to FIG. 8 in an alternative modular construction of the drum 160, the segments 170 are formed of longitudinal lengths 176, each length being identical and defining a number of windings. In various embodiments, the longitudinal lengths 176 are identical and are assembled by friction fit to form a drum of a desired length. Each segment 170 includes a plurality of tabs 172 and corresponding recesses 174 for engaging additional segments. In this configuration, it has been found advantageous to dispose the longitudinal segments 176 about a substantially rigid core 180 such as an aluminum core as seen in FIG. 6. The core 180 provides structural rigidity for the segments 176. In addition, the core 180 does not require extensive manufacturing processes, and can be merely cut to length as necessary.

The modular construction of the drum 160 allows for the ready assembly of a variety of drum lengths. In a first configuration, the drum has an approximate 7-inch diameter with a 0.20 right handed helical pitch. In addition, the drum can be constructed of a plastic such as a thermosetting or thermoplastic material.

The drum 160 includes or is fixedly connected to the drive shaft 114, wherein the drive shaft is rotatably mounted relative to the frame 20.

Bias Mechanism:

Although the lift assembly 10 can be employed without requiring counterweights, it is contemplated that a bias mechanism can be employed to reduce the effective load to be raised by the lift assembly. For example, a torsion spring may be disposed between the shaft 114 and the frame 20 such that upon rotation of the shaft in a first direction (generally an unwinding direction), the torsion spring is biased and thus urges rotation of the drum in a winding or lifting rotation. Further, the present lift assembly 10 can be operably connected to an existing counterweight system, wherein the drive mechanism 100 actuates existing counterweights.

Cable Path:

The location of the head blocks 80 on helical head block mount 30, the drum diameter and the cable sizing can be selected to define a portion of the cable path and particularly a cable take off point. The cable path starts from a winding section 162 on the drum, to a tangential take off point from the winding about the drum 160. The cable path then extends to the respective head block 80. The cable path is redirected by the head block 80 to extend horizontally along the length of the frame 20 to a corresponding loft block 220, wherein the loft block may be internal or external to the frame. Each cable path includes the take-off point and a fleet angle, the angle between the take of point and the respective head block 80.

As a portion of the cable path for each cable extends parallel to the longitudinal axis of the drum, the take off points for the plurality of winding sections 162 are spaced about the circumference of the drum 160 due to the mounting of the head blocks 80 along the helical head block mount 30. In a first configuration of FIG. 2, the seven take off points are disposed within an approximate 90 degree arc of the drum periphery.

In general, an equal length of cable 14 can be disposed about each winding section. The length of the cable paths between the take off point and the end of the frame 20 is different for different cable paths. Thus, a different length of cable 14 may extend from its respective take off point to the end of the frame 20. However, the lift assembly 10 is constructed so that an equal length of each cable 14 may be operably played from each winding section 162 of the lift assembly 10.

Load Brake:

The load brake 130 can be located mechanically intermediate the drum 160 and the gearbox 120, as shown in FIG. 3. The load brake 130 includes a drive disc 132, a brake pad 134, a driven disc 136, and a peripheral ratchet 138, a tensioning axle 140 and a tensioning nut 146.

The drive disc 132 can be connected for rotation with the drive shaft 114 in a one-to-one correspondence. That is, the drive disc 132 can be fixedly attached to the drive shaft 114. The drive disc 132 can include a concentric threaded coupling 133. The driven disc 136 can be fixably connected to the drum 160 for rotation with the drum. The driven disc 136 can be fixably connected to the tensioning axle 140. The tensioning axle 140 can extend from the driven disc 136. The tensioning axle 140 can include or is fixably connected to a set of braking threads 141 and a spaced set of tensioning threads 143. The brake pad 134, friction disc, can be disposed about the tensioning axle 140 intermediate the drive disc 132 and the driven disc 136 and can include the peripheral ratchet 138, which is selectively engaged with a pawl 139.

To assemble the load brake 130, the tensioning axle 140 can be disposed through a corresponding aperture in the gearbox 120 such that the tensioning threads 143 protrude from the gearbox. The braking threads 141 engage the threaded coupling 133 of the drive disc 132. The tensioning nut 146 can be disposed on the tensioning threads 143. The brake pad 134 can thus disposed between the drive disc 132 and the driven disc 136 to provide a friction surface to each of the discs.

In rotating the motor 110 in a raising or winding direction, the braking threads 141 screw into the corresponding threaded coupler 133 on the drive disc 132, thereby causing the driven disc 136 and the drive disc 132 to compress the brake pad 134. That is, the longitudinal distance between the drive disc 132 and the driven disc 136 decreases. The drive disk 132, the brake pad 134 and the driven disc 136 thus turn as a unit as the cable 14 is wound upon the drum 160.

To lower or unwind cable 14 from the drum 160, the motor 110 and hence drive disc 132 are rotated in the opposite direction. Upon initiation of this direction rotation, the pawl 139 can engage the ratchet 138 to preclude rotation of the brake pad 134. As the drive disc 132 is rotated by the motor 110 in the lowering direction, the breaking threads 141 tend to cause the driven disc 136 to move away from the drive disc 132 and hence the brake pad 134, thus allowing the load on the drum 160 to rotate the drum in an unwinding direction. Upon terminating rotation of the drive disc 132 in the lowering direction of rotation, the load on the cable 14 causes the drum 160 and hence driven disc 136 to thread the braking threads 141 further into the coupler 133 against the now fixed braking pad 134 thereby terminating the unwinding rotation of the drum.

The tensioning nut 146 can be used to determine the degree of release of the driven disc 136 from the brake pad 134. The tensioning nut 146 can also be used to accommodate wear in the brake pad 134. The present configuration thus provides a general balance between the motor induced rotation of the drive disc 132 in the unwinding direction and the torque generated by the load on the cable 14 tending to apply a braking force as the driven disc 136 is threaded toward the drive disc 132.

Clip Assembly:

The frame 20 and external loft blocks 220 can be mounted to the building by at least one adjustable clip assembly 40. Each clip assembly 40 can include a J-shaped sleeve 50, a retainer 60 and a J-shaped slider 70. The sleeve 50 and the slider 70 can each have a closed end and a leg. The closed end of the sleeve 50 and the slider 70 can be constructed to engage the flange of a beam, as shown in FIG. 1.

The leg of the sleeve 50 can be sized to slideably receive the retainer 60 and a section of the leg of the slider 70. The sleeve 50 includes a plurality of inwardly projecting teeth 52 at regularly spaced distances along the longitudinal dimension of the leg of the sleeve.

Figure 9:
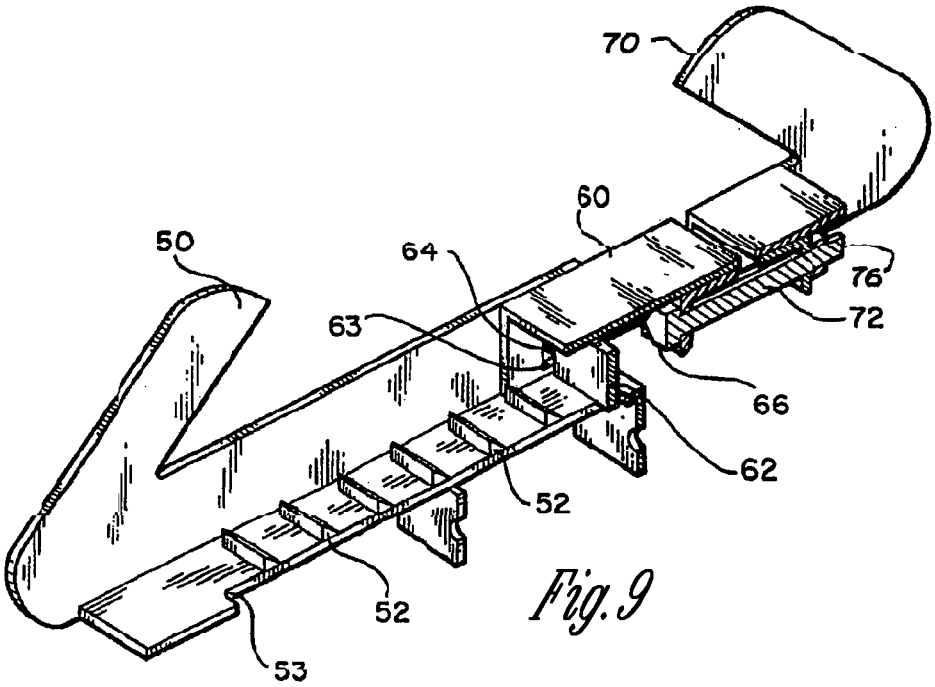
FIG. 9 is a perspective partial cut away view of a clip assembly.

The retainer 60 can be sized to be slideably received within the leg of the sleeve 50. The retainer 60 includes a pair of opposing slots 63 as shown in FIG. 9. A capture bar 62 having corresponding ears 64 can be disposed within the slots 63. The slots 63 in the retainer 60 and the ears 64 of the capture bar 62 are sized to permit the vertical displacement of the capture bar between a lower capture position and a raised release position. The capture bar 62 is sized to engage the teeth 52 of the sleeve 50 in the capture position and be disposed above the teeth in the raised position, whereby the teeth can pass under the capture bar. The retainer 60 further includes a threaded capture nut 66 fixed relative to the retainer.

The slider 70 can be connected to the retainer 60 by a threaded shaft 72. The threaded shaft 72 is rotatably mounted to the slider 70 and includes an exposed end 76 for selective rotation of the shaft. The rotation of the threaded shaft 72 may be accomplished by a Phillips or regular screw head, a hexhead or any similar structure. The threaded shaft 72, the retainer 60 and the slider 70 are selected to permit the retainer to be spaced from the slider between a maximum distance approximately equal to the distance between adjacent teeth 52 in the sleeve 50, and a minimum distance, where the retainer abuts the slider.

In addition, the sleeve 50 can include an elongate slot 53 extending along the length of the leg having the teeth 52. The slot 53 allows an operator to contact the capture bar 62 and urge the capture bar upward to the raised release position thus allowing the sleeve 50 and the retainer 60/slider 70 to be moved relative to each other and the beam, thereby allowing either release of the clip assembly 40 or readjustment to a different sized beam section. According to at least one construction, the sleeve 50, the retainer 60 and the slider 70 are sized to accommodate the beam flanges having a 4" to a 10" span. The sleeve 50, the retainer 70 and the slider 70 are formed of ⅛" stamped steel.

Control-Power Strip:

As shown in FIG. 2, the present lift assembly also contemplates a control/power strip 90 sized to be disposed between the flanges of a beam. The control strip 90 can include a housing 92 and cabling for supplying electricity power as well as control signals. The housing 92 can provide support to the cabling and can substantially enclose the cabling or merely provide for retention of the cabling. Typically, the control strip 90 includes interconnects at 12 inch centers for engaging a plurality of frames 20. The control strip 90 is attached to the beam by any of a variety of mechanisms including adhesives, threaded fasteners as well as clamps.

Loft Block:

As shown in FIG. 1, the plurality of loft blocks 220 corresponding to the plurality of head blocks 80, can be connected to the building in a spaced relation from the frame 20. The loft blocks 220 are employed to define the portion of the cable path from a generally horizontal path section that extends from the frame 20 to a generally vertical path section that extends to the batten 12 or load. Depending upon the length of the batten 12 and the width of the stage, there may be as few as one or two loft blocks 220 or as many as six, eight, twelve or more.

As shown in FIG. 2, one, two or more internal loft blocks 220 can be located within the frame 20 to allow for cables 14 to pass downward within the footprint of the frame. Thus, the present lift assembly reduces the need for wing space in a building to accommodate counterweight systems.

Typically, at each loft blocks 220, there is a load cable 222 and a passing cable 224, wherein the load cable is the cable redirected by the loft block to extend downward to the batten 12 and the passing cable continues in a generally horizontal direction to the subsequent loft block. In some configurations, the loft blocks 220 accommodate the load cable 222 as well as any passing cables 224.

Figure 10:
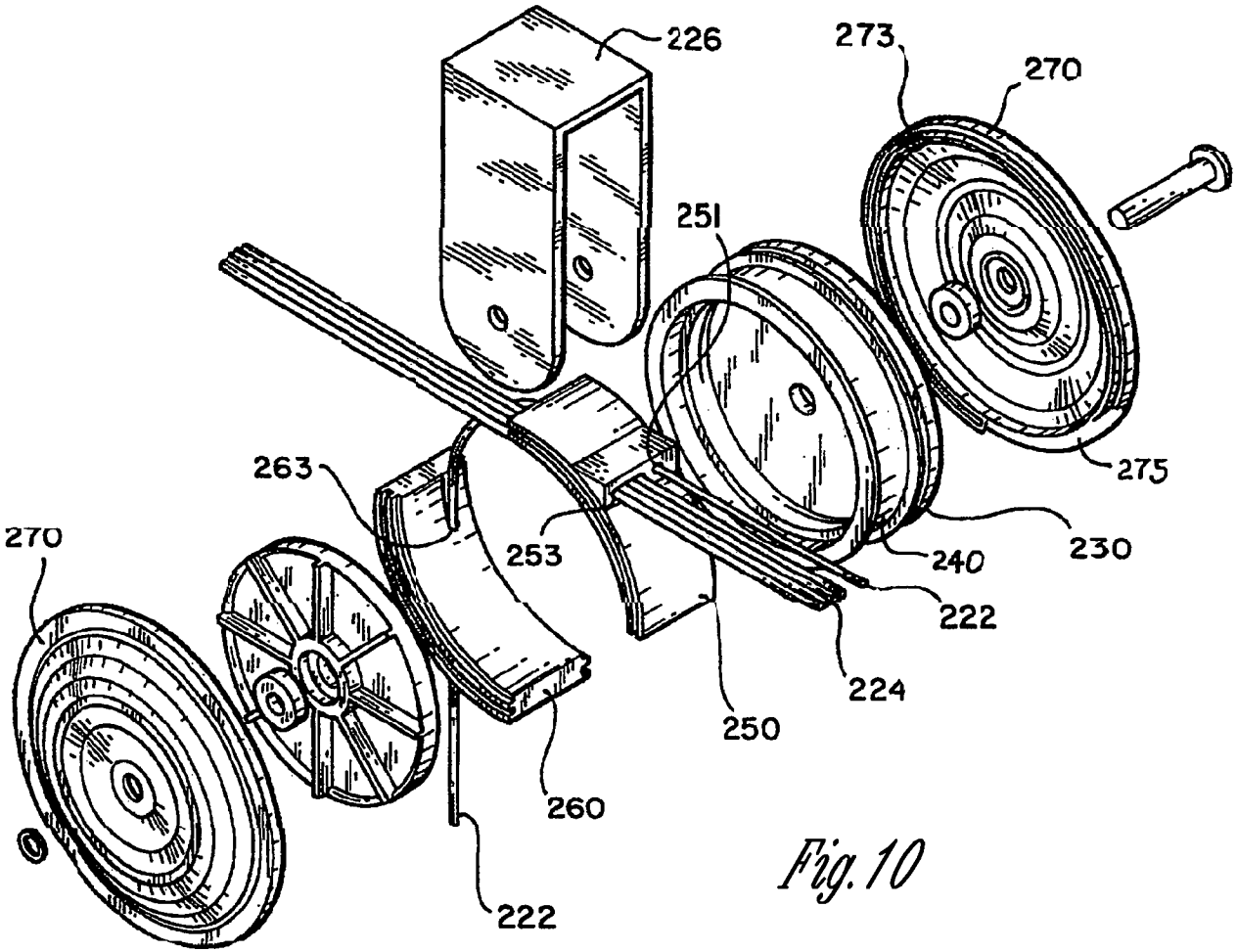
FIG. 10 is an exploded perspective view of a loft block.

Referring to FIG. 10, each loft blocks 220 can include a load sheave 230, an optional carrier sheave 240, an upstream guide 250, a downstream guide 260 and a pair of side plates 270. The load sheave 230 can be constructed to engage and track the load cable 222, and the carrier or idler sheave 240 can be constructed for supporting the passing (through) cable 224. It is contemplated the load sheave 230 and the carrier sheave 240 may be a single unit having a track for the load cable 222 and separated track or tracks for the passing cables 224. In some constructions, the carrier sheave 240 is a separate component that engages the load sheave 230 in a friction fit, wherein the load sheave and the carrier sheave rotate together. This construction allows the loft block 220 to be readily constructed with or without the carrier sheave 240 as necessary. Alternatively, the load sheave 230 and the carrier sheave 240 can be separately rotatable members.

The upstream guide 250 can include a through cable inlet 251 and a load cable inlet 253, wherein the through cable inlet is aligned with the carrier sheave 240 and the load cable inlet is aligned with the load sheave 230. The upstream guide 250 can be configured to reduce a jumping or grabbing of the cables 14 in their respective sheave assembly. The downstream guide 260 can be located about the exiting path of load cable 220. Typically, the downstream guide includes a load cable exit aperture 263.

The side plates can be sized to engage the load and carrier sheaves 230, 240 as well as the upstream and downstream guides 250, 260 to form a substantially enclosed housing for the cables 14. The side plate 270 can include a peripheral channel 273 for engaging and retaining the upstream guide 250 and the downstream guide 260. The peripheral channels 273 can include an access slot 275 sized to pass the upstream guide 250 and the downstream guide 260 therethrough. In the operating alignment, the peripheral channel 273 can retain the upstream guide 250 and the downstream guide 260. However, the side plates 270 can be rotated to align the access slot 275 with the upstream guide 250 or the downstream guide 260 so that the guides can be removed from the side plates. The loft block 220 can thereby allows components to be removed without requiring pulling the cables 14 through and subsequent re-cabling.

The loft block 220 can include a shaft about which the load sheave 230, the carrier sheave 240 (if used), and the side plates 270 are concentrically mounted.

The loft block 220 can engage a coupling bracket 226, wherein the coupling bracket maybe joined to a clip assembly 40 such that the coupling bracket is moved about a pair of orthogonal axis to accommodate tolerances in the building.

Controller:

It is further contemplated the present lift assembly may be employed in connection with a controller 200 for controlling the drive mechanism 100. Specifically, the controller 200 be a dedicated device or alternatively can include software for running on a personal computer, wherein control signals are generated for the lift assembly 10.

Stop Sensor:

A proximity sensor or detector 280 can be fixed relative to the load, the batten 12 or the elements connected to the batten 12. The sensor 280 can be any of a variety of commercially available devices including infra red, ultrasound or proximity sensor. The sensor 280 is operably connectable to the controller by a wire or wireless connection such as infrared. The sensor 280 can be configured to detect an obstacle in the path of the batten 12 moving in either or both the lowering direction or the raising direction. The sensor 280 can provide a signal such that the controller 200 terminates rotation of the motor 110 and hence stops rotation of the drum 160 and movement of the batten 12 upon the sensing of an obstacle.

It is contemplated the sensor 280 may be connected to the batten 12, wherein the sensor includes an extendable tether 282 sized to locate the sensor 280 on a portion of the load carried by the batten. Thus, the sensor 280 can be operably located with respect to the batten 12 or the load. According to some embodiments, the sensor is sized and colored to reduce visibility by a viewing audience. It is also understood the sensor can be selected to preclude the batten from contacting the deck, floor or stage.

Figure 11:
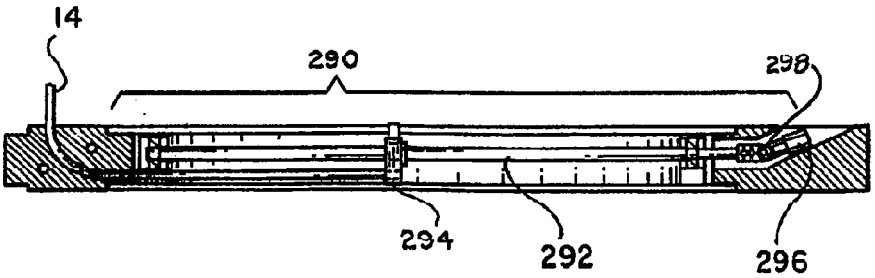
FIG. 11 is a cross-sectional view of the trim adjustment.
Figure 7:
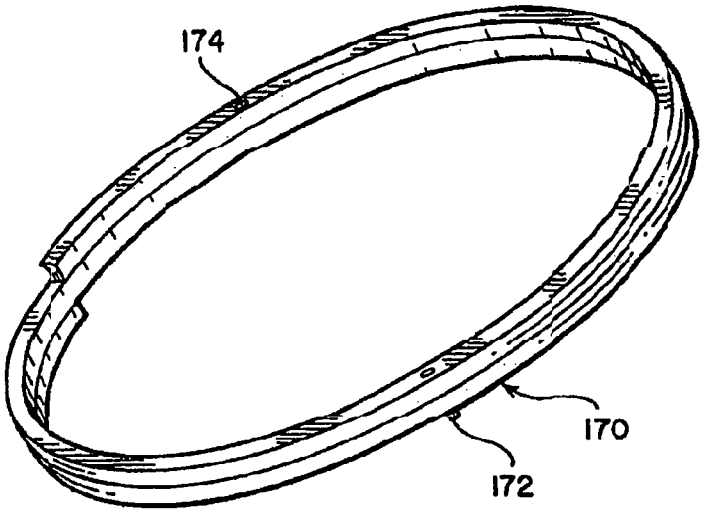
FIG. 7 is a perspective view of a longitudinal drum segment.

Trim Adjustment:

Referring to FIG. 11 the present lift assembly further provides for a trim adjustment 290. That is, the relatively fine adjustment of the length of cable in the drop line section of the cable path.

In a first configuration of the trim adjustment 290, the structure is sized and selected to be disposed within the cross-sectional area of the batten 12. Thus, the trim adjustment 290 is substantially unobservable to the audience. The trim adjustment can be located within a length of the batten 12, or form a portion of the batten such as a splice or coupler.

The trim adjustment 290 includes a translator 292 that is rotatably mounted to the batten 12 along its longitudinal dimension and includes a threaded section. The trim adjustment 290 further includes a rider 294 threadedly engaged with the threaded section of the translator 292, such that upon rotation of the translator, the rider is linear disposed along the translator.

The cable 14 can be fixedly connected to the rider 294 such that is the rider is translated relative to the batten 12, additional cable 14 can either drawn into the batten or is passed from the batten.

Rotation of the translator 292 is provided by a user interface 296 such as a socket, hex head or screw interface. Typically, the user interface includes a universal joint 298 such that the interface may be actuated from a non-collinear orientation with the translator.

While the (linear) translator 292 and associated rider 294 are shown in the first configuration, it is understood that a variety of alternative mechanisms may be employed such as ratchets and pawls, pistons, including hydraulic or pneumatic as well as drum systems for taking up and paying out a length of cable 14 within a cross-sectional area of a batten 12 to function as trim adjustment height in a rigging system.

Installation:

The lift assembly 10 can be constructed to accommodate a predetermined number of cables 14, and hence a corresponding number of winding sections 162 on the drum 160 and head blocks 80. In addition, upon shipment, the internal loft blocks 220 as well as the external loft blocks 220 can be disposed within the frame 20. In addition, each cable 14 can be prestrung so that the cable topologically follows its own cable path.

The hoisting adapters 26 can be threaded with the cable 14 and the separate clip assemblies 40 are connected to a pair of cables from the drum 160. The cable 14 can be fed from the respective winding section and the clip assemblies are connected to the building. The drum 160 can then rotated to hoist the frame 20 to the installation position. Clip assemblies 40 connected to the frame 20 can be connected to an adjacent beam of the building. The clip assemblies 40 can be engaged with the respective beams and sufficiently tightened to retain the clip relative to the beam. The hoisting clip assemblies on the cables 14 can be removed from the building and the cables, and the hoisting adapter are removed from the frame. The frame 20 can thus be retained relative to the structure.

Upon the frame 20 being attached to the respective beams, the external loft blocks 220 can be removed from the frame and sufficient cable 14 drawn from the drum 160 to locate the loft block adjacent to the respective structural beam. The loft block 220 can then connected to the beam by the clip assembly 40. The load cable 222 from each loft block 220 can be operably connected to a batten 12 or load. The trim adjustment 290 can then be employed to adjust the relative length of the drop line, as necessary.

Figure 12:
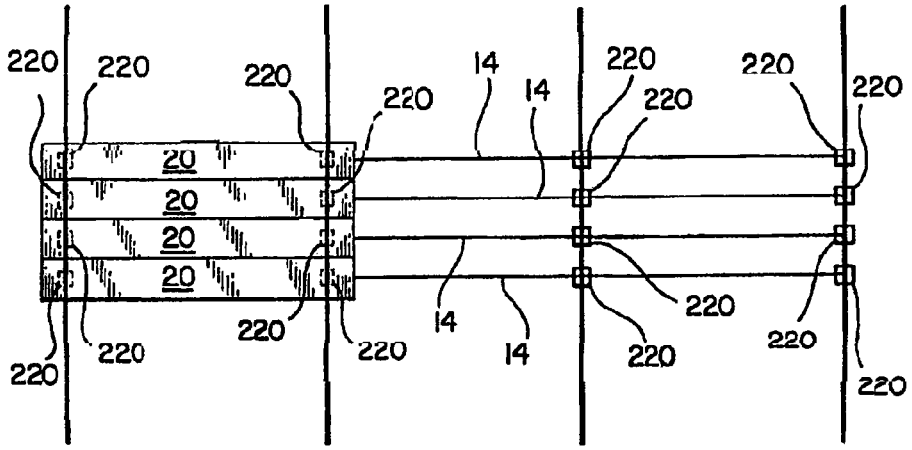
FIG. 12 is a schematic representation of a plurality of frames connected to a building.
Figure 13:
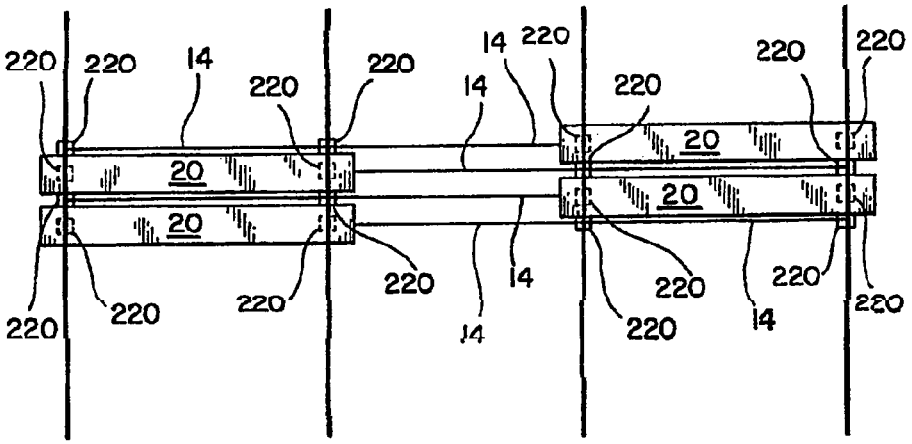
FIG. 13 is a schematic of an alternative arrangement of the frame relative to a building.

As the head blocks 80 longitudinally overlap along the axis of rotation of the drum 160, the frame 20 can have an approximate 9-11 inch width. Thus, a plurality of frames 20 can be connected to the building in an abutting relation with the drum axis in parallel to provide location on 12-inch centers as seen in FIG. 12. Alternatively, as shown in FIG. 13, as the frame 20 can be constructed to include the external loft blocks 220 in any relation to the internal loft blocks, the frames can be staggered along the width of the stage. That is, the second frame is spaced from the first frame in the longitudinal direction such that the ends of the sequential frames are spaced apart.

Operation:

In operation, upon actuation of the motor 110, the drive shaft 114 and the drum 160 can rotate in the unwind rotation. Such rotation locks the brake pad 134 and threads the driven disc 136 away from the drive disc 132, which allows cable 14 from each winding section to be paid out from the drum 160 at the respective takeoff point.

The rotation of the shaft 114 which winds or unwinds cable 14 to or from the drum 160 also causes rotation of the threaded portion of the shaft. Rotation of the threaded portion relative to the keeper 115 induces a linear translation of the drum 160 along the axis of drum rotation during winding and unwinding rotation of the drum.

The threading of the threaded portion, the sizing of the drum 160 and the cable 14 are selected such that the fleet angle, or fleet angle limit, is maintained between each head block 80 and the takeoff point of the respective winding section 162. Thus, by longitudinally translating the drum 160 during unwinding and winding rotation, the fleet angle for each head block 80 and corresponding take off point in the winding section 162 is maintained.

As the fleet angles are automatically maintained, there may be no need for a movable connection between a plurality of head blocks 80 along the helical mount and the frame to maintain a desired fleet angle.

In the bias mechanism configuration, as the drum 160 is rotated with an unwinding rotation, tension is increased in the torsion spring. Thus, upon rotation of the shaft and hence drum in the winding direction, the torsion spring assists in such rotation, thereby reducing the effect of weight of the load such as the batten and any accompanying equipment. This reduction in the effective load allows the sizing of the motor, and gearbox to the adjusted accordingly.

The above Detailed Description includes references to the accompanying drawings, which form a part of the Detailed Description. The drawings show, by way of illustration, specific embodiments in which the invention can be practiced. These embodiments are also referred to herein as "examples." All publications, patents, and patent documents referred to in this document are incorporated by reference herein in their entirety, as though individually incorporated by reference.

In the event of inconsistent usages between this document and those documents so incorporated by reference, the usage in the incorporated references should be considered supplementary to that of this document; for irreconcilable Inconsistencies, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated.

In the appended claims, the terms "including" and "in which" are used as the plain-English equivalents of the respective terms "comprising" and "wherein." Also, in the following claims, the terms "including" and "comprising" are open-ended, that is, a system, assembly, device, article, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more features thereof) can be used in combination with each other. Other embodiments can be used, such as by one of ordinary skill in the art upon reviewing the above description. Also, in the above Detailed Description, various features can be grouped together to streamline the disclosure. This should not be interpreted as intending that an unclaimed disclosed feature is essential to any claim. Rather, inventive subject matter can lie in less than all features of a particular disclosed embodiment. Thus, the following claims are hereby incorporated into the Detailed Description, with each claim standing on its own as a separate embodiment. The scope of the invention should be determined with reference to the appended claims, along with the full scope of equivalents to which such claims are entitled.

The Abstract is provided to comply with 37 C.F.R. §1.72 (b), to allow the reader to quickly ascertain the nature of the technical disclosure. It is submitted with the understanding that it will not be used to interpret or limit the scope or meaning of the claims.

What is claimed is:

1. A lift assembly, comprising:

a frame;

a drum rotatably connected to the frame about an axis of rotation and having at least one winding section;

a plurality of head blocks spaced about the drum at more than one radial distance from the axis of rotation;

a drive mechanism operatively connected to the drum for rotating the drum; and a plurality of cables each windable about the drum and connectable to a load, the plurality of cables being directed from the drum via the plurality of head blocks to a generally vertical path to support the load, wherein at least one of the plurality of cables is directed in a generally vertical path that is internal relative to the frame and that is within a footprint of the frame.

2. The lift assembly of claim 1, wherein each of the plurality of cables are directed from the drum in a direction that is substantially parallel to the axis of rotation before being directed to the generally vertical path.

3. The lift assembly of claim 2, wherein each of the plurality of head blocks engage a corresponding one of the plurality of cables and direct the corresponding cable in the direction that is substantially parallel to the axis of rotation.

4. The lift assembly of claim 1, wherein the plurality of head blocks are longitudinally aligned along the drum.

5. The lift assembly of claim 1, further comprising a loft block spaced from each of the plurality of head blocks, each head block and loft block combination defining a cable path passing from the drum to the head block and then substantially parallel to the axis of rotation to the loft block.

6. The lift assembly of claim 1, wherein the drum is translatable relative to the frame along the axis of rotation.

7. The lift assembly of claim 6, wherein translation of the drum maintains a fleet angle of each cable relative to the drum during raising or lowering of the load.

8. The lift assembly of claim 1, further comprising at least one loft block for engaging each cable and directing the cable to the generally vertical path.

9. The lift assembly of claim 1, wherein the drive mechanism comprises a motor, operatively connected to the drum, and a gearbox connected to the motor.

10. A lift assembly, comprising:

a frame;

a drum rotatably connected to the frame about an axis of rotation and having a plurality of winding sections;

a drive mechanism operatively connected to the drum for rotating the drum;

a plurality of cables each windable about one of the plurality of winding sections of the drum and connectable to a load; and a plurality of head blocks coupled to the frame, each head block configured for directing at least one of the plurality of cables from the drum to a generally vertical path that is internal relative to the frame and that is within a footprint of the frame, wherein a first head block, of the plurality of head blocks, is at a first radial spaced position, relative to the axis of rotation, different from a second radial spaced position of a second head block, of the plurality of head blocks.

11. The lift assembly of claim 10, wherein at least one of the plurality of head blocks is configured for directing at least one of the plurality of cables from the drum to one of a plurality of generally vertical paths, external relative to the frame, to support the load.

12. The lift assembly of claim 11, wherein the plurality of generally vertical paths of the cables, external to the frame, are spaced apart to support the load.

13. The lift assembly of claim 11, wherein the at least one of the head blocks is configured to direct the at least one cable from the drum in a direction that is substantially parallel to the axis of rotation before directing the at least one cable to the generally vertical path.

14. The lift assembly of claim 11, wherein each head block of the plurality of head blocks are configured for engaging one of the plurality of cables and directing the one cable in a direction that is substantially parallel to the axis of rotation.

15. The lift assembly of claim 14, comprising a plurality of loft blocks, each loft block spaced from a corresponding one of the plurality of head blocks and, in conjunction with the corresponding one head block, defining a cable path passing from the drum to the head block and then substantially parallel to the axis of rotation to the loft block.

16. The lift assembly of claim 10, wherein the drum is translatable relative to the frame along the axis of rotation.

17. The lift assembly of claim 16, wherein translation of the drum maintains a fleet angle of each cable relative to the drum during raising or lowering of the load.

18. The lift assembly of claim 10, wherein the drive mechanism comprises a motor, operatively connected to the drum, and a gearbox connected to the motor.

19. The lift assembly of claim 10, further comprising a load brake mechanically coupled to a portion of the drum or a drive shaft about which the drum rotates.

* * * * *